US006805261B1

(12) United States Patent
Laudenberg

(10) Patent No.: US 6,805,261 B1
(45) Date of Patent: Oct. 19, 2004

(54) FLEXIBLE TUBE AND METHOD OF MANUFACTURE

(75) Inventor: Bernd Laudenberg, Wipperfurth (DE)

(73) Assignee: Profile Packaging, Inc., Sarasota, FL (US)

( * ) Notice: Subject to any disclaimer, the term of this patent is extended or adjusted under 35 U.S.C. 154(b) by 0 days.

(21) Appl. No.: 09/830,906

(22) PCT Filed: Oct. 10, 2000

(86) PCT No.: PCT/US00/28013

§ 371 (c)(1),
(2), (4) Date: May 2, 2001

(87) PCT Pub. No.: WO01/26988

PCT Pub. Date: Apr. 19, 2001

Related U.S. Application Data

(60) Provisional application No. 60/158,555, filed on Oct. 8, 1999.

(51) Int. Cl.[7] ..... B65D 35/08

(52) U.S. Cl. ..... 222/107; 222/569; 383/80; 53/133.2; 53/490

(58) Field of Search ..... 222/92, 107, 569, 222/568, 566; 383/80, 906; 220/254; 215/44, 276; 53/133.2, 133.1, 412, 455, 490

(56) References Cited

U.S. PATENT DOCUMENTS

| | | | | | |
|---|---|---|---|---|---|
| 1,769,259 | A | * | 6/1930 | Henry | 383/66 |
| 2,687,158 | A | * | 8/1954 | Owen | 206/521 |
| RE25,765 | E | * | 4/1965 | Ankney | 222/569 |
| 4,512,136 | A | * | 4/1985 | Christine | 53/410 |
| 5,600,933 | A | * | 2/1997 | Wiles et al. | 53/133.4 |
| 5,845,466 | A | * | 12/1998 | Laudenberg | 53/568 |
| 6,142,341 | A | * | 11/2000 | Uematsu | 222/92 |

* cited by examiner

*Primary Examiner*—Gene Mancene
*Assistant Examiner*—Patrick Buechner
(74) *Attorney, Agent, or Firm*—Gifford, Krass, Groh, Sprinkle, Anderson & Citkowski, P.C.

(57) ABSTRACT

A package and method of making and filling it in the form of a tubular flexible bag of laminated plastic sheet material with a dispensing fitment including a spout and a removable closure mechanically fastened to a flat wall at one end of the tubular bag with the method of making the filled package being continuous starting with a flat sheet of material and ending with a filled and closed package.

15 Claims, 2 Drawing Sheets

FLEXIBLE TUBE AND METHOD OF MANUFACTURE

This application claims the benefit of Provisional application Ser. No. 60/158,555, filed Oct. 8, 1999.

FIELD OF THE INVENTION

This invention relates to packaging and more particularly to tubular bags and fitments for such bag tubes together with the method of making and filling such packages.

BACKGROUND OF THE INVENTION

Bag tubes are flexible packages, which combined many of the advantages of bags and tubes for packaging of liquid and paste products.

The dispensing of product from prior art tubular packages typically is afforded by providing for tearing away a portion of the bag tube, for example, at a corner edge or to provide a dispensing spout which is bonded to a wall of the bag.

It would be desirable to form a dispensing spout which can be mechanically fastened to a wall of the tubular container.

Prior art bag tubes typically are formed with a flexible wall or gusset at one end of the bag which extends between the front and back panels making up the tubular body of the package and forms the bottom of the closed tube which forms a base to support the filled flexible bag in an upright position. In the present invention, a fitment forming a dispensing spout is installed in the end wall which now becomes the top of the finished and filled package.

The fitment itself is provided with a flange which extends for the full thickness of the package and acts to support the flexible end wall during manufacture and also during dispensing of contents of the package by the ultimate consumer.

Aside from the advantages of such packages from the standpoint of marketing, shipping and storage, it is highly desirable that the packages be made and filled in a continuous process starting with a roll of film from which the package is shaped, filled and sealed in a single continuous operation. Such an inline production method eliminates the need for prefabrication of tubes with storage of a supply until ready for use.

SUMMARY OF THE INVENTION

It is an object of the invention to provide a bag tube and a method of making and filling it in a continuous process and in which the bag tube is formed with a dispensing spout and screw type closure which makes it possible to open and close the package without the need to empty all the contents.

Another object of the invention is to provide a bag tube having an end provided with a fitment affording a dispensing spout and closure which permits dispensing and resealing of the contents remaining in the package.

Another object of the invention is to provide a fitment for a bag tube which facilitates installation during manufacture and use of the flexible package by the ultimate consumer.

These and other objects of the invention are attained by the present invention in which a pair of opposed panels of flexible plastic laminated material have a pair of opposed sealed edges and a sealed bottom portion to form a flat tube closed at one end. The closed end of the tube extends between the panels and supports a fitment including a dispensing nozzle and a detachable closure which is mechanically fastened to the end wall by means of an anchor member inserted through the open end of the package and threadably engage with the nozzle portion of the fitment. The fitment itself is provided with an elongated flange which extends diametrically of the passage in the spout for the full width of the filled package to engage opposite sides of the package to resist torque during manufacture and to facilitate handling of the package by the consumer during opening and closing of the spout.

BRIEF DESCRIPTION O THE DRAWINGS

DETAILED DESCRIPTION

Figure 1:
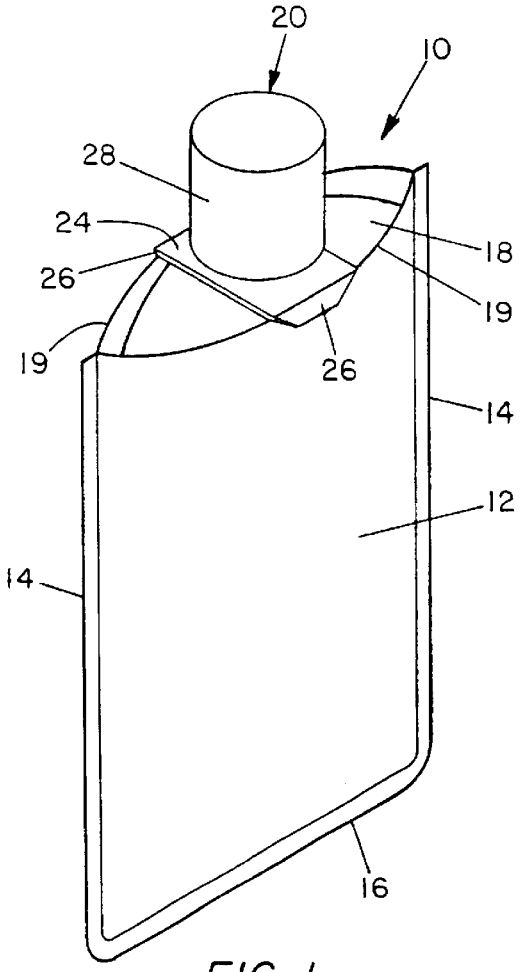
FIG. 1 is a perspective view of a bag tube package made in accordance with the method of the invention.

The finished and filled bag tube embodying the invention is designated generally at 10 in FIG. 1 and includes a pair of opposed walls 12 of plastic material which are sealed together at opposite side edges 14 to form a tubular structure which when filled has a generally oval cross-section. The bottom of the package is heat sealed similarly to the side edges 14 to form an elongated bottom seam 16. The upper end of the tube package 10 is formed with a flat wall or gusset 18 which supports a fitment 20. An edge portion 19 is formed at the top of the walls 12 at the perimeter of gusset 18.

Figure 2:
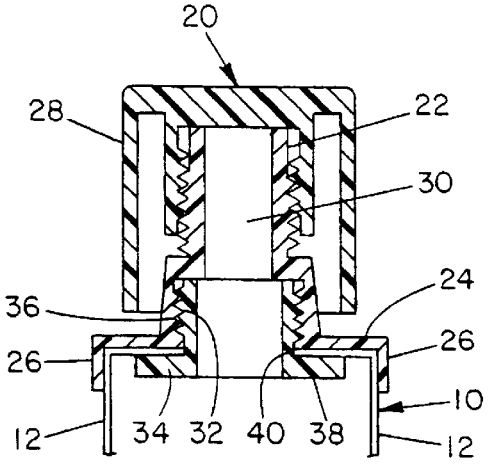
FIG. 2 is a cross-sectional view at an enlarged scale showing the fitment with a pouring spout and closure at one end of the bag tube.

As seen in FIG. 1, the fitment 20 includes a tubular spout 22 having an elongated flange or plate 24 at one end which extends the full thickness of the filled package 10. Opposite ends of the plate 24 are formed with tabs 26 which extend from the plate opposite to the spout to engage opposite sides of the upper end of package 10. Referring to FIG. 2, the plate end of spout 22 is provided with internal threads 32 in a passage 30 to receive an anchor or plug element 34. Anchor element 34 includes an externally threaded stem or tube 36 having an annular flange 38 at one end. Anchor element 34 is positioned inside the tubular package member to pass through an opening 40 in the wall or gusset 18 to threadably engage the internal threads 32 in spout 22. With threads 36 and 32 tightly engaged, the film material around the opening 40 is trapped between the flange 38 of the plug or anchor 34 and the plate 24 of the fitment 20.

An internally threaded cap 28 can be threadably mounted on the externally threaded spout 22 to close the axial passage 30 in the spout 22. The entire fitment assembly, including the spout 22, cap 28 and anchor element 34, can be made of plastic.

Figure 4:
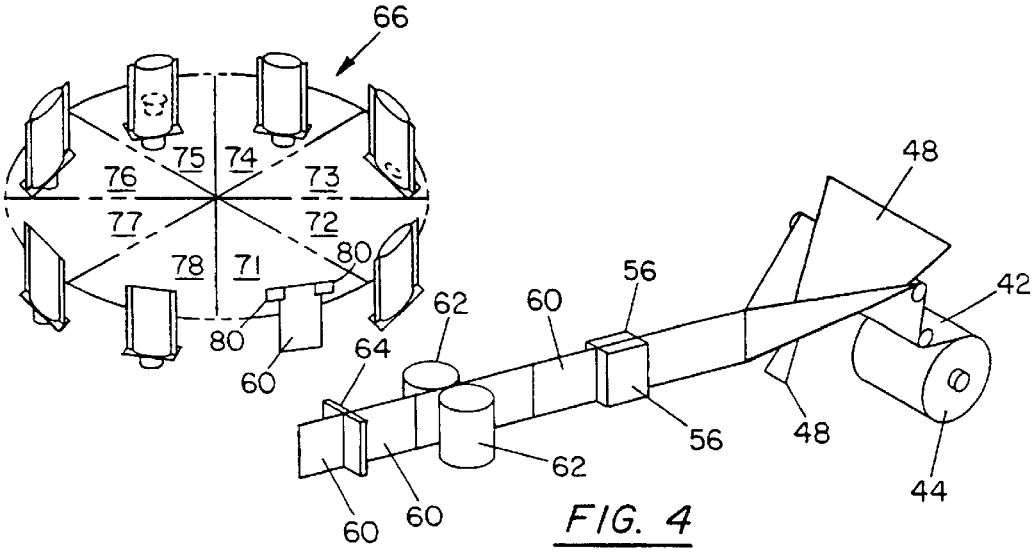
FIG. 4 is a diagrammatic, perspective view of a horizontal bag-making machine employing the method of the present invention.
Figure 5:
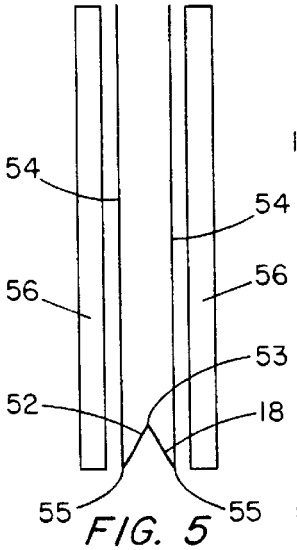
FIG. 5 is a diagrammatic, cross-sectional view of the folded material at one stage of the method of forming a bag tube.
Figure 6:
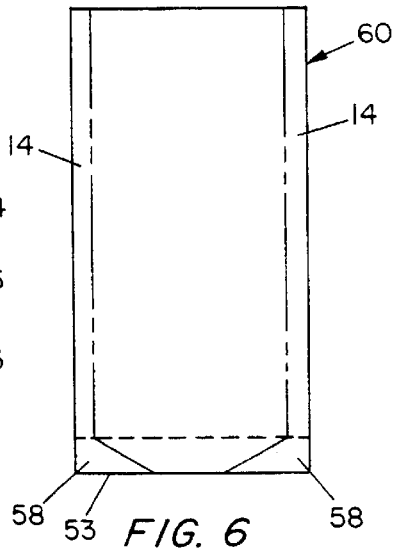
FIG. 6 is an elevation of a partially formed bag tube in a flat condition.
Figure 7:
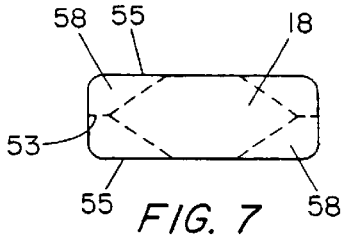
FIG. 7 is a bottom view of the package shown in FIG. 6 in an open or unfolded condition of the bag tube.

The construction of the bag tube 10 is similar in many respects to the making of pouch type packages described in Laudenberg U.S. Pat. No. 5, 845,466. Referring to FIG. 4, a continuous sheet of film 42 of preprinted, laminated plastic film is stored on a supply roll 44 and is dispensed through a forming mechanism 48 at opposite surfaces of the sheet 42 which folds the sheet material into a cross-sectional configuration as shown in FIG. 5 so that portions of one sheet surface face each other. As seen in FIG. 5, at the bottom of the folded sheet, a folded portion 52 extends upwardly between opposed outer portions 54 so that a fold line 53 is formed centrally of the gusset 18. Also a pair of fold lines 55 are formed at the bottom of outer portions 54 to form the edges 19 of the gusset 18 as seen in FIG. 1. The facing surface of the sheet material is a sealant surface of a plastic material which responds to heat to fuse and bond together with a surface of like material. Heat is applied by way of heat sealant bars indicated diagrammatically at 56 in FIGS. 4 and 5 to opposite sides of the web assembly to fuse the side edges 14 and bottom portions 58 as shown in FIG. 6 to form a partial bag tube 60. Subsequently, the bag tubes 60, which remained attached to each other, pass between rolls 62 which apply pressure to opposite sides to insure that the heated surfaces bond to each other. Thereafter, the partially completed tubes are cut from the adjoining sheet material by shears 64 and are transferred to a first workstation. Preferably the first station is formed on a rotating turret 66 which can consist of eight stations 71–78 making it possible to simultaneously conduct eight different operations on eight bags.

Figure 8:
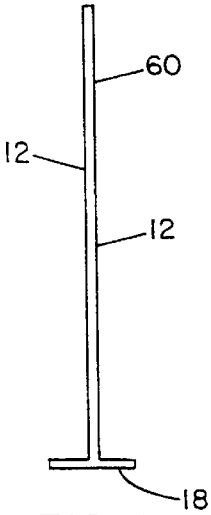
FIG. 8 is an edge view of the bag with the bottom unfolded as seen in FIG. 7.
Figure 9:
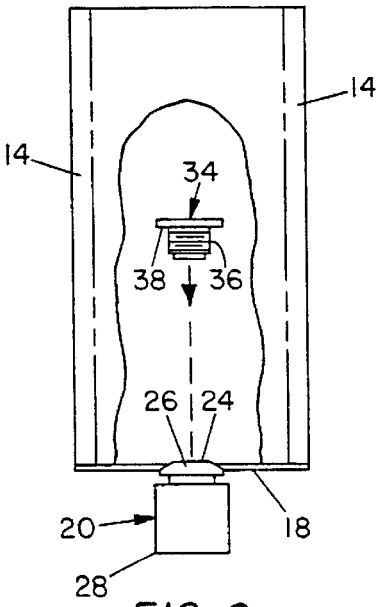
FIG. 9 is a side view with parts broken away and removed showing the relative position of parts at one of the stages of forming the bag tube package.
Figure 10:
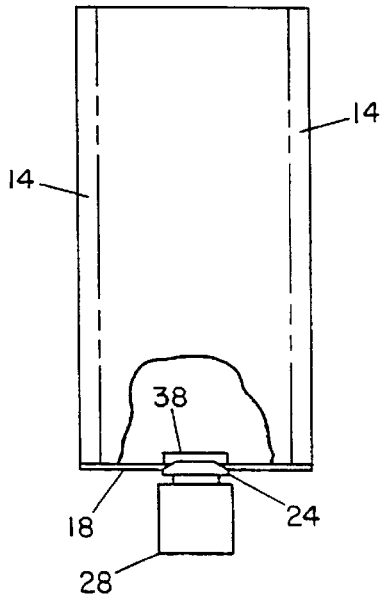
FIG. 10 is a view similar to FIG. 9 showing the fitment installed in the partially completed package.
Figure 11:
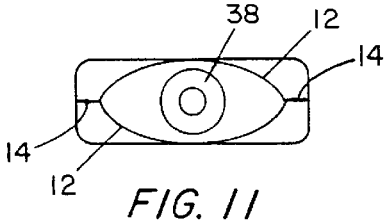
FIG. 11 is a top view of the partially finished bag tube in an open condition ready for filling.

The turret 66 may have one or more sets of grippers 80 at each station as disclosed in U.S. Pat. No. 5,845,466. In FIG. 4 grippers are indicated only at station 71. As seen in FIG. 4, at a first station 71, a pair of grippers 80 grasp opposite side edges of the flat tube 60 near the open end of the partially formed tube 60 so that the gusset end 18 is disposed downwardly. Upon rotation of turret 66 to a second station 72, the grippers 80 are moved mechanically toward each other to open the tube so that the partially completed package 60 has a generally elliptical cross-section as viewed from the top as seen in FIG. 11. Also the bottom of the tube 60 is unfolded as seen in FIG. 8 so that the gusset 18 is at its full width and at right angles to the walls 12 of the partially formed bag tube 60.

After the tube 60 is opened at the second station 72, it is moved to the next station 73, where the opening 40 is die cut in the bottom wall or gusset 18 and the cut material is removed. The die cutter may be robotically operated.

The turret 66 is then rotated to a fourth station 74 where a tubular spout 22 forming a part of fitment 20 is placed under opening 40 in gusset 18. The spout 22 has a closure 28 already in place and is positioned so that the plate 24 extends across the width of the gusset 18 with the tabs 26 extending upwardly towards the open end of the tube 60.

Figure 3:
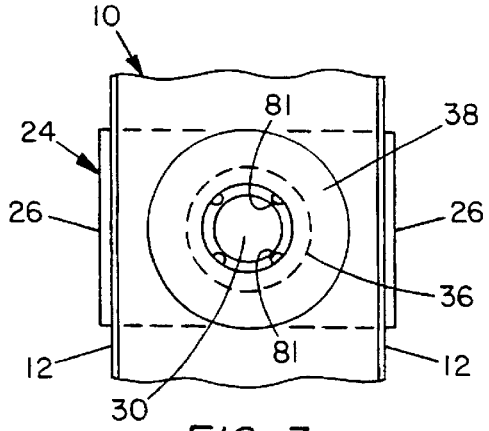
FIG. 3 is a bottom view of one of the elements of the fitment in FIG. 2.

The turret 66 is rotated and at a fifth station 75 the anchor element 34 is introduced through the open end of the partially formed tube 60 by a robotic arm (not shown). To facilitate handling, the anchor element 34 is provided with a plurality of ribs 81 on the interior wall of tube 36 as seen in FIG. 3. The ribs 81 facilitate handling of the anchor element 34 during manipulation in the bag tube 60. The anchor element 34 is moved downwardly so that the externally threaded tube 36 passes through opening 40 to engage the internal threads 32 in the axial passage 30 of the tubular spout 22. The ribs 81 facilitate application of torque to anchor element 34 during twisting of the threads of tube 36 relative to the stationary internal threads in tubular spout 22 to tightly engage the film material of the partially formed bag tube 60 and capture the material surrounding the die cut opening 40 between the annular flange 38 of the anchor element 34 and the plate element 24 at the end of tubular spout 22. The gusset end 18 of the tubular package is now completely closed.

Upon rotation of the turret 66 to the next station 76, the product to be packaged is fed into the upper, open end of the tube 60 which remains held by the grippers 80. After the tube 60 is filled with product, the grippers 80 arc moved apart to close the upper end of the tube 60. The turret 66 is then rotated to the next station 77 where heat-sealing elements can be moved to engage opposite side edges of the upper end of filled tube 60 and form the seam 16. The turret 66 can then be rotated to the last station 78 where the grippers 80 are open to release the filled package 10 for transfer to additional handling equipment such as conveyors and the like by which the filled packages 10 are moved for further packaging in cartons for shipment.

A bag tube, fitment and method of forming and filling such a bag tube have been provided for packaging paste materials, cosmetics and the like which is lighter in weight and less costly to produce. The method eliminates the need to have a cap-closing machine since the spout fitment is supplied with a cap such as a tamper evident cap already in position. The bag tube is provided with a fitment affording a dispensing spout closed with a threaded closure. The fitment acts to reinforce the flexible closed end of the flexible bag tube and facilitate manufacture and subsequent use. The method provides for producing the pouch in a single operation and no inventory of empty tubes is necessary. The material of plastic laminate permits flexography or gravure printing.

I claim:

1. A flexible tubular package with a dispensing spout at one end comprising:

a pair of opposed panels having sealed opposed side edges to form a tube, a bottom edge of said panels being fused together to form a closed tube, an end of said tube having an end wall extending between said panels, a fitment secured to said end wall including a dispensing spout forming a dispensing passage normal to the outside surface of said end wall, said spout having threads formed in said dispensing passage, and an anchor member disposed at the inside surface of said wall for engagement with said fitment to hold the latter in sealing engagement with said wall, said anchor member having an externally threaded stem engaging said threads of said dispensing passage.

2. The combination of claim 1 wherein said end wall is flexible and formed of the same material as said panels.

3. The package of claim 1 wherein a removable closure is disposed on said nozzle spout.

4. The package of claim 1 wherein said opposed panels and said end wall are formed of a single sheet of material.

5. The package of claim 4 wherein said single sheet of material is folded and said closed edges and end wall are heat-sealed.

6. The package of claim 1 wherein said spout has an elongated flange extending between and engaging said panels.

7. The method of forming and filling a flexible, tubular package having a closable pouring spout, comprising:

forming a flexible, tubular package with an open end and a wall forming a closed end, forming an aperture in said wall, positioning a fitment with a spout having an internally threaded passage extending between a pair of open ends and a plate at one end larger than said aperture adjacent to said wall at the exterior of s aid package and in alignment with said aperture, inserting an anchor member having a threaded stem and an annular flange larger than said aperture into said package through said open end with said stem in said aperture and into engagement with said threaded passage, rotating said anchor member relative to said fitment to engage said threads on said anchor member with the threads in said passage to draw said annular flange and said plate into sealed engagement with opposed surfaces of said wall at said closed end of said tubular package, filling said package with a product, and sealing said open end of said package.

8. The method of claim 7, wherein said tubular package is formed of a sheet of flat plastic material and wherein a pair of side edges and said closed end of said package are formed by applying heat to said closed end and side edges.

9. The method of claim 7, wherein said tubular package is flat initially and said package is moved to an open position prior to forming said aperture in said wall at said closed end.

10. The method of claim 7, wherein said ends of said tubular package are moved to an open position by moving opposite side edges of said package toward each other.

11. The method of claim 7, wherein said aperture is formed by die cutting and the cut material is removed from said aperture at the exterior of said package.

12. The method of claim 7, wherein said package has its open end moved to a closed position by moving opposite side edges of said tube away from each other after said tube is filled.

13. The method of claim 12, wherein said open end of said package is heat sealed after said opposed side edges have been moved away from each other.

14. The method of claim 7, wherein said anchor member is rotated relative to said fitment to engage said threads and move said annular flange and plate into sealing engagement with opposed surfaces of said wall.

15. The method of claim 7, wherein said tubular package is formed by folding a single sheet of plastic foil and applying heat to opposite sides of said sheet to seal opposed edges and to form said closed end.

* * * * *

UNITED STATES PATENT AND TRADEMARK OFFICE

CERTIFICATE OF CORRECTION

PATENT NO. : 6,805,261 B1
DATED : October 19, 2004
INVENTOR(S) : Bernd Laudenberg It is certified that error appears in the above-identified patent and that said Letters Patent is hereby corrected as shown below:

Column 2,
Line 10, replace “Brief Description o the Drawings” with -- Brief Description of the Drawings --.

Column 4,
Line 16, replace “arc” with -- are --.
Line 62, replace “on said nozzle spout” with -- on said spout --.

Column 5,
Line 12, replace “of s aid” with -- of said --.

Signed and Sealed this

Third Day of May, 2005

JON W. DUDAS
*Director of the United States Patent and Trademark Office*